United States Patent [19]

Alexander et al.

[11] Patent Number: 4,462,470

[45] Date of Patent: Jul. 31, 1984

[54] EXTRUSION OF BENTONITE CLAY FOR FLUID LOSS REDUCTION IN DRILLING FLUIDS

[75] Inventors: William Alexander, Naperville; Ira E. Odom, Vernon Hills, both of Ill.

[73] Assignee: American Colloid Company, Skokie, Ill.

[21] Appl. No.: 460,175

[22] Filed: Jan. 24, 1983

Related U.S. Application Data

[62] Division of Ser. No. 309,727, Oct. 8, 1981, abandoned.

[51] Int. Cl.[3] ..... E21B 21/00

[52] U.S. Cl. ..... 175/72; 175/66; 425/311; 252/8.5 LC

[58] Field of Search ..... 175/72, 64, 66, 206; 166/285, 292; 264/141, 142, 108; 425/202, 309-311, 313; 252/8.5 LC, 8.5 R

[56] References Cited

U.S. PATENT DOCUMENTS

| | | | |
|---|---|---|---|
| 2,231,328 | 2/1941 | Simons | 252/309 X |
| 2,488,129 | 11/1949 | Lande, Jr. | 264/176 R |
| 2,583,600 | 1/1952 | Schreiber | 425/311 X |
| 2,634,098 | 4/1953 | Armentrout | 175/72 |
| 2,642,268 | 6/1953 | Armentrout | 175/72 |
| 2,836,555 | 5/1958 | Armentrout | 175/72 |
| 2,900,668 | 8/1959 | Hubner et al. | 264/142 |
| 3,111,739 | 11/1963 | Horton et al. | 264/108 |
| 3,727,308 | 4/1973 | Ross | 425/311 X |
| 4,242,140 | 12/1980 | Alther | 501/146 |

*Primary Examiner*—James A. Leppink
*Assistant Examiner*—Thuy M. Bui
*Attorney, Agent, or Firm*—Mason, Kolehmainen, Rathburn & Wyss

[57] ABSTRACT

The fluid loss and viscosity loss characteristics of a water expandable bentonite clay are substantially improved by extruding the clay through die openings while, at the same time, passing a wiper or scraping blade across the entrance of the die openings. In this manner, very inexpensive and low grade clays can be substantially improved and thus modified making such clays acceptable in fluid loss and viscosity for use in a drilling fluid or mud.

16 Claims, 6 Drawing Figures

EXTRUSION OF BENTONITE CLAY FOR FLUID LOSS REDUCTION IN DRILLING FLUIDS

This is a divisional application of prior application Ser. No. 309,727 filed on Oct. 8, 1981, now abandoned.

BACKGROUND OF THE INVENTION

Drilling fluid or mud is used in drilling operations, such as oil well drilling, by circulating the drilling fluid in the hole being drilled for contact with the drill bit to cool and lubricate the bit. In addition, the drilling fluid serves to carry away drill cuttings from the hole and seals porous strata from drilling fluid or mud penetration.

One commercially acceptable drilling fluid or mud comprises a dispersion of sodium bentonite in water. The sodium bentonite portion of this type of drilling fluid raises the viscosity and yield point of the drilling fluid. The purpose of increasing the viscosity is so that the drilling fluid is more able to raise the cuttings to the surface where the cuttings can be removed by means of screens and the like. Other additives have been included in sodium bentonite type drilling fluids oftentimes in an attempt to prevent loss of the circulated drilling fluid through the porous surfaces surrounding the drill hole.

DESCRIPTION OF THE PRIOR ART

U.S. Pat. No. 2,642,268 discloses bentonite in a compacted condition in the form of small lumps or pellets in order to prevent the wetting or penetration of the interior of the lumps by water until the lumps have reached that portion of a well hole which is to be sealed. Thus, the pellets or lumps of bentonite provide a time-release characteristic but is not intended to actually improve the fluid loss characteristics of the bentonite. As stated in the patent, the problem with using sodium bentonite in more finely divided form is that the bentonite has already expanded by the time it reaches the porous formation and therefore, according to the patent, is virtually useless in preventing fluid loss.

U.S. Pat. No. 2,836,555 also discloses a time-release method for introducing bentonite into a well hole by compressing the bentonite into pellets and coating the pellets with a water insoluble coating, thereby delaying water absorption of the bentonite. U.S. Pat. No. 2,634,098 is another example of a time-release method for introducing loss circulation material into a well hole wherein the loss circulation material is in the form of granules or pellets having a water soluble coating which requires a short interval of time to dissolve.

U.S. Pat. No. 3,700,474 discloses a method of grinding a clay, such as bentonite, to compact and crush the clay so that the clay slakes when brought into contact with water. The compaction and crushing accelerates the responsiveness of the clay to water.

U.S. Pat. No. 4,242,140 also discloses compacting platey-type clays, such as bentonite, to improve the viscosity and fluid loss characteristics.

U.S. Pat. No. 1,991,637 discloses bentonite clay for use in a drilling fluid.

U.S. Pat. No. 2,856,354 discloses finely divided bentonite clay coated with a water-repellant coating for recovering lost circulation in drilling wells.

U.S. Pat. No. 2,231,328 discloses treating calcium montmorillonite clay in an auger extrusion machine at a pressure substantially in excess of 100 pounds per square inch as measured at the die plate. The clay so treated breaks down onto a much finer particle size than can be obtained by fine grinding. Such treated clay will slake readily when mixed with water. Typical extrusion apparatus is shown in U.S. Pat. No. 2,079,854.

SUMMARY OF THE INVENTION

In accordance with the present invention, the viscosity and fluid loss characteristics of a water expandable bentonite clay are substantially improved by extruding the clay through die openings while, at the same time, passing a wiper or scraping blade across the entrance of the die openings. In this manner, very inexpensive and low grade clays can be substantially improved and thus modified making such clays acceptable in viscosity and fluid loss for use in a drilling fluid or mud and for use in foundry applications and the like.

Others, (see Simons U.S. Pat. No. 2,231,328) have recognized that the extrusion of water expandable clays will increase the viscosity of the clay for use in drilling muds. In accordance with the present invention, it has been found that by using a wiper or scraping blade on the entrance side of the die openings as the clay is extruded through the die openings, the viscosity and fluid loss characteristics of the clay can be substantially and unexpectedly improved compared to a clay extruded through die openings without the wiper or scraping blade.

DETAILED DESCRIPTION OF THE PREFERRED EMBODIMENT

Figure 1:
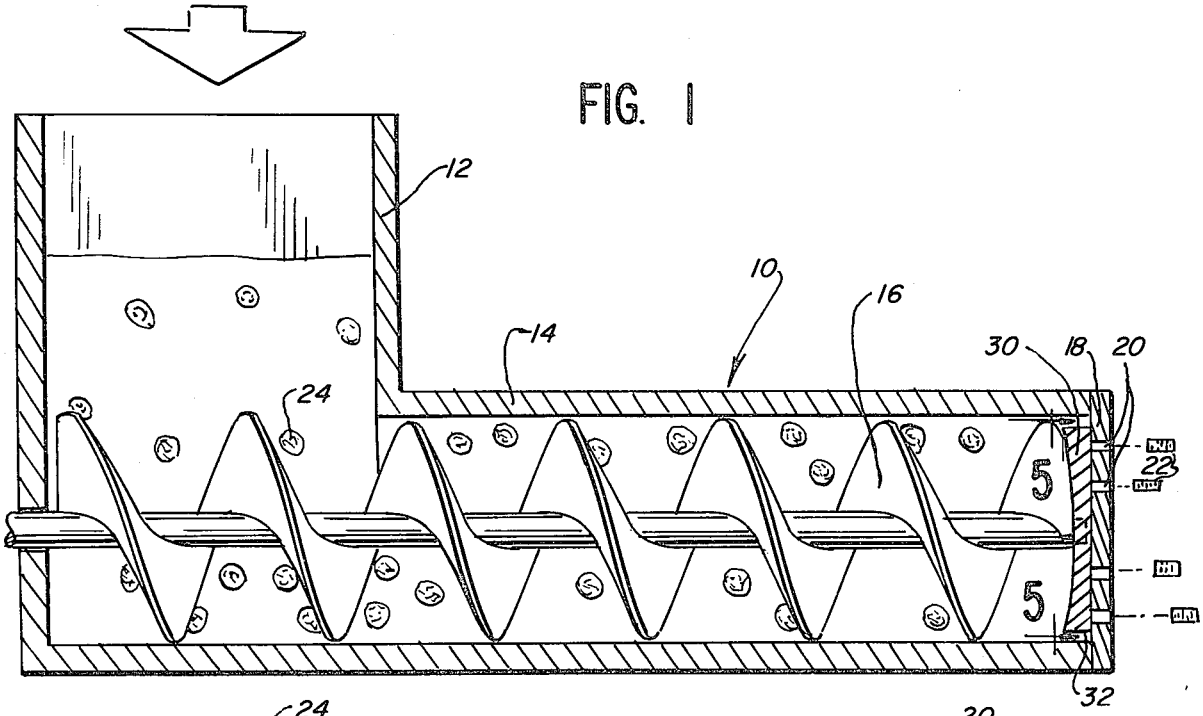
FIG. 1 is a cross sectional view of extrusion apparatus used to extrude and cut clay particles in accordance with the present invention.

The bentonite used in accordance with the present invention is one capable of hydrating on contact with water. A preferred bentonite is sodium bentonite which is basically a hydratable montmorillonite clay having sodium as its predominant exchangeable ion. However, the bentonite utilized herein may also contain other cations such as magnesium, calcium and iron. Normally the exchangeable ion will be sodium since this is the most abundant of the water-swellable bentonites. When extruded with a rotating wiper blade, scraping blade, or cutter, the finely divided bentonite of the present invention has greatly increased apparent and plastic viscosity as well as greatly reduced fluid loss characteristics as compared to the same bentonite material extruded without using the wiper, scraper or cutting blade. Sodium bentonite is composed of layers, sheets or platelets (crystals) with the exchangeable cation occurring between the layers. The layers (crystals) are randomly oriented in crude clay particles. Extrusion, such as disclosed in the Simons patent 2,231,328, has been used to rupture the structure of the clay particle while the clay particles are moist by subjecting the particles to sufficient shear forces, thereby breaking the clay particles along various randomly oriented shear planes corresponding to the flat plate structure of the bentonite particles.

While the clay particles are broken apart by a simple extrusion, it has been found that extruding the clay through die openings does not materially orient or align the flat plates or platelets of the clay structure. In accordance with the present invention, it has been found, unexpectedly, that by rotating a wiper, scraper or cutting blade against the structure surrounding the entrance of a die opening during extrusion, the characteristics of viscosity and fluid loss in the clay are substantially improved over simple extrusion and, quite unexpectedly, the flat plates of the clay structure are substantially completely aligned in parallel relationship perpendicular to the axis of the rotating cutting blade. Apparently, it is this alignment that separates flat clay plates from each other to produce the unexpected increase in viscosity and unexpected decrease in fluid loss characteritics discovered in accordance with the present invention.

The clay thus extruded and cut or wiped in accordance with the present invention, exits from the die opening in pellet form having the flat plates of the clay structure aligned perpendicular to the longitudinal axis of the pellet. The pellets break off from the exit end of the die opening when the pellet increases in length sufficiently to provide enough weight that the pellet breaks at the die opening exit due to the increasing pellet weight. Thus, the wiper, scraper or cutting blade does not have the effect of chopping the clay into distinct pellet size but operates to align and separate the flat plates of the clay structure and unexpectedly increases the viscosity, both apparent and plastic, and substantially and unexpectedly decreases the fluid loss of the clay.

The extrusion of the clay in accordance with the present invention is conveniently carried out by using either a pug mill or auger extruder. Pug mills have been commonly used in the production of bricks and other ceramic materials. In general, conventional pug mills include a tubular housing having one end open for receiving clay materials and the other end closed with an exit or die for extruding the clay material therethrough. The pug mill is further provided with a longitudinal axis having blades disposed radially thereon. In operation, the central axis is rotated to provide shearing forces to the material within the pug mill. The blades are inclined at a slight degree so that as they turn, they force the clay material forward, toward the exit or extruding end. In this way, shear pressure forces are applied to the material within the pug mill. The amount or intensity of shearing forces imparted by the extrusion and wiping blade, in accordance with the present invention, readily may be varied by changing the feed rate of bentonite, blade size and/or blade angle, or the size of the extruding or die opening. Also, the rotation speed of the central axis driving the mixing or auger blades and speed of the wiping blade may be varied to change shearing forces. The particular operating conditions and pug mill dimensions may be varied widely.

Application of shear pressure forces also conveniently may be applied utilizing a conventional auger extruder. Auger extruders are similar to pug mills except that the central rotating axis has a single or double screw type mixing blade which, when rotated in the appropriate direction, mixes and conveys the bentonite toward and then through one or more die openings at the extruding end of the extruder housing. As with the pug mill, the particular dimensions, including the extruder port or die hole size and shape and/or wiper design and operating conditions may be varied widely to provide the bentonite with differing degrees of clay platelet alignment and separation.

The most convenient way to regulate the degree of clay platelet alignment on the bentonite is to change the size of the exit or extruder port and frequency of rotation of the wiper or cutting blades. By varying the amount or flow rate of bentonite flowing through the extruder port, the number or frequency of cutting blade passes through the bentonite per unit pellet length, the degree of clay platelet alignment can be regulated to desired levels.

Generally, the moisture content of the clay should be in the range of 20–40% by weight when the clay is extruded. If the clay is too dry, it would be forced through the die openings in a powdery form without sufficient platelet alignment and therefore, insufficient improvement in viscosity and fluid loss characteristics. If too wet when extruded, the clay becomes very sticky and may very well clog the extruder. In one embodiment, the bentonite clay is sheared at the die opening 4,000 to 10,000 times per minute.

Referring now to Table I, five bentonite samples from different geological locations were obtained. The initial moisture of the samples was about 25% by weight. As mined, bentonite generally contains anywhere from 20 to 40 or 45% water which is partially removed down to, for example, from 5 to 10 weight % moisture, prior to grinding. In accordance with the present invention, the extruded and wiped bentonite pellets are dried so that it only contains 5 to 15 weight % moisture and thereafter it may be ground to a desired particle size for a desired use. Portions of each of the bentonite samples were extruded both with and without a wiping blade or cutter through a ½ horsepower laboratory auger extruder having a ¼-inch thick die plate with ⅜-inch die openings. The extruded, or extruded and cut clay was dried to approximately 10% moisture by weight and ground so that 85% of the clay passed a 200 mesh screen. The clay was suspended in water at 6¼% solids by weight and allowed to age overnight. The extruded and wiped bentonite samples and the samples merely extruded were tested for apparent viscosity, plastic viscosity, yield point and fluid loss. The results of these tests are shown in Table I.

TABLE I

Improvements in API Properties of Western Na bentonites produced by Extrusion. Note that extrusion with wiper substantially reduces fluid loss compared to extrusion without wiper.

| | | API Properties | | | |
|---|---|---|---|---|---|
| Sample | Conditions | Apparent Viscosity | Plastic Viscosity | Yield Point | Fluid Loss |
| 1 | Crude | 3.5 | 2 | 3 | 37.74 |
| | Extruded Without Wiper | 4.5 | 4 | 11 | 29.17 |

TABLE I-continued

Improvements in API Properties of Western Na bentonites produced by Extrusion. Note that extrusion with wiper substantially reduces fluid loss compared to extrusion without wiper.

| Sample | Conditions | API Properties Apparent Viscosity | Plastic Viscosity | Yield Point | Fluid Loss |
|---|---|---|---|---|---|
| | Extruded With Wiper | 10.5 | 4 | 13 | 18.53 |
| 2 | Crude | 3.5 | 3 | 1 | 23.23 |
| | Extruded Without Wiper | 4.5 | 3 | 3 | 13.36 |
| | Extruded With Wiper | 6.0 | 5 | 2 | 11.53 |
| 3 | Crude | 6.5 | 4 | 5 | 17.96 |
| | Extruded Without Wiper | 8.5 | 5 | 5 | 14.25 |
| | Extruded With Wiper | 8.0 | 4 | 8 | 13.50 |
| 4 | Crude | 7.5 | 7 | 1 | 18.49 |
| | Extruded Without Wiper | 9 | 7 | 4 | 14.66 |
| | Extruded With Wiper | 10.0 | 8 | 4 | 12.70 |
| 5 | Crude | 22.5 | 18 | 9 | 12.90 |
| | Extruded Without Wiper | 15.0 | 12 | 6 | 12.14 |
| | Extruded With Wiper | 14.5 | 12 | 5 | 11.28 |
| 6 | Crude | 3.5 | 2 | 3 | 37.70 |
| | Extruded Without Wiper | 9.0 | 2 | 14 | 23.85 |
| | Extruded With Wiper | 10.0 | 4 | 12 | 17.47 |

As can be seen, the extruded and wiped bentonite has an unexpectedly lower fluid loss than bentonite extruded without the wiper, and the apparent viscosity of the wiper treated extruded bentonite samples are also unexpectedly greater than the apparent viscosity of the samples extruded without the wiper.

Increases in compacting and shearing forces on the bentonite resulting from extrusion through smaller die openings increases the apparent viscosity and fluid loss prevention. To demonstrate this effect, four samples of bentonite were extruded through a ½ horsepower laboratory auger extruder utilizing four different sized die plates or extrusion ports with the wiper blade. The extruded clay was dried to about 10% by weight moisture and ground to a powder. The powder was suspended in water at 6¼% by weight solids and allowed to age overnight. The four different compositions were tested for their API properties of apparent viscosity, plastic viscosity, yield point and fluid loss. These four properties are characteristics or qualities of bentonite which are important in its use as a drilling mud. As can be seen from Table II, as the extruding die or port opening is decreased (increase in compacting and shearing pressures), the fluid loss is reduced and apparent viscosity increased.

TABLE II

| | Apparent Viscosity After | Plastic Viscosity After | Yield Point After | Fluid Loss After |
|---|---|---|---|---|
| Extra Large ¾" | 7.0 | 5.0 | 4.0 | 14.7 |
| Large ⅜" | 9.5 | 6.0 | 7.0 | 11.8 |
| Small ¼" | 10.0 | 6.0 | 8.0 | 11.0 |
| Extra Small ⅛" | 11.5 | 5.0 | 13.0 | 10.9 |

Figure 2:
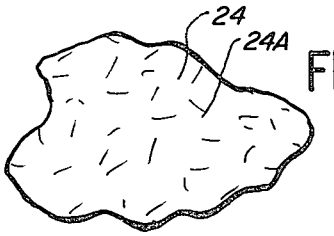
FIG. 2 is an enlarged cross sectional view of a crude clay particle prior to treatment in accordance with the present invention showing the clay flat plates or platelets in random orientation.
Figure 3:
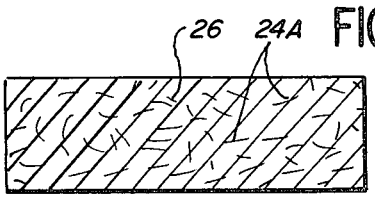
FIG. 3 is a partially broken away cross sectional view of a clay pellet extruded without using a wiper blade showing the flat platelets in random orientation.

Referring now to the drawing, and initially to FIG. 1, there is illustrated extrusion and cutting or wiping apparatus generally designated by reference numeral 10. The extrusion/cutting apparatus 10 generally includes a hopper 12 for maintaining a level of moist (i.e. 20–40% by weight water) bentonite clay, an elongated extrusion barrel 14 having a rotatable auger 16 disposed therein, and a die or extrusion plate 18 disposed at one extreme end of the extrusion barrel 14, including one or more die openings 20 for extruding aligned clay pellets 22 therethrough. Crude clay particles 24, best shown in FIG. 2, include a plurality of flat platelets 24A randomly aligned throughout the clay mass 24. Mere extrusion of the clay through die openings 20 without using a wiper blade on the entrance of the die openings 20 produces a clay pellet 26, as illustrated in FIG. 3, having platelets 24A substantially randomly aligned.

Figure 4:
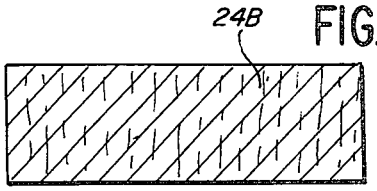
FIG. 4 is a partially broken away cross sectional view of a pellet extruded using a wiping blade in accordance with the present invention showing the flat platelets of the clay particle aligned perpendicular to the longitudinal axis of the pellet.

In accordance with an important feature of the present invention, a wiper blade 30 is disposed in contact with an interior surface 32 of the die plate 18 to cut, dissaggregate, and orient the clay platelets, to provide a clay pellet having a majority of oriented clay platelets 24B, as best shown in FIG. 4. The wiper blade 30 may be a single blade or, as best shown in FIG. 5, can include a number of blade arms 34 each having a tapered blade portion 36 disposed in wiping or cutting contact against the interior surface 32 of die plate 18.

As shown in FIG. 1, the wiper blade 30 can be an integral part of the auger 16 or structurally connected thereto so that the wiping blade 30 rotates at the same speed as the auger 16. As an example, the auger 16 and wiping blade 30 having 4 blade arms 34 are rotated at 1750 R.P.M. to provide excellent clay platelet orientation and separation to substantially increase the viscosity and decrease the fluid loss. The particular speed of the wiping blade may be varied widely while achieving sufficient platelet alignment for unexpected improvement in viscosity and fluid loss characteristics.

Figure 5:
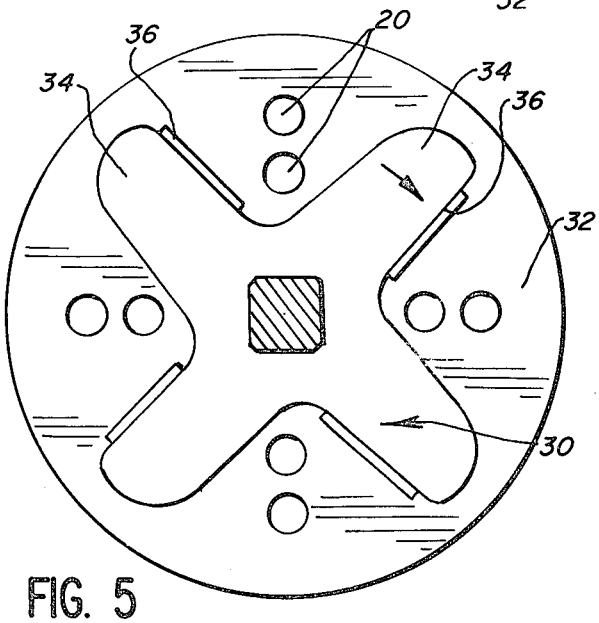
FIG. 5 is an enlarged end view of the apparatus of FIG. 1 taken through the line 5—5 of FIG. 1 showing the wiping blade and die openings.
Figure 6:
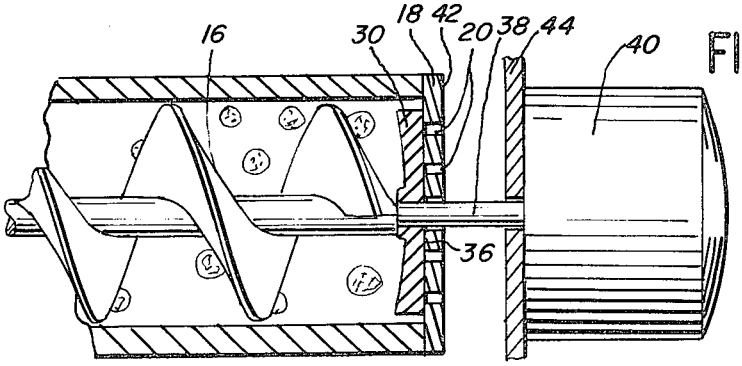
FIG. 6 is a partially broken away cross sectional view showing an alternative embodiment of apparatus useful in accordance with the present invention where the wiping blade is connected to an exterior motor.

In accordance with another embodiment of the present invention, shown in FIG. 5, the wiping blade 30 is connected through motor shaft 38 to a separate variable speed motor 40 so that the wiping blade 30 can be rotated at a speed independent of the speed of rotation of the auger 16. In accordance with the embodiment shown in FIG. 6, the motor 40 is spaced from an outer end 42 of the die plate 18 to provide an intermediate space for the pellets 22 to fall into a collection hopper (not shown) and a motor shield 44 is disposed between the outer die plate end 42 and the motor 40 to prevent the pellets 22 from contacting and wetting the motor 40.

Having thus described exemplary embodiments of the present invention, it should be noted by those skilled in the art that various other alternatives, adaptations and modifications may be made within the scope of the present invention. Accordingly, the present invention is not limited to the specific embodiments as illustrated herein.

We claim:

1. A method of drilling comprising rotating a drilling bit within an earthen structure to form a drill hole defined by a surrounding earthen structure and circulating a drilling fluid containing ground bentonite clay within said drill hole to cool and lubricate said drilling bit, and to carry away drill cuttings from said drill hole, said bentonite clay having improved fluid loss characteristics by forcing said bentonite clay through a die opening while simultaneously shearing said bentonite clay along a plane defined by an entrance to said die opening, and thereafter grinding said bentonite clay.

2. A method as defined in claim 1 wherein said shearing is accomplished by disposing a wiper blade in contact with an interior surface of a wall containing said die opening, forcing said bentonite clay through said die opening, and moving said wiper blade across said die opening as said bentonite clay is extruded through said die opening to separate and align crystals of said bentonite clay in a direction perpendicular to a longitudinal axis of said die opening.

3. A method as defined in claim 1 wherein said bentonite clay is forced through said die opening by rotating an auger within a bentonite-containing housing to force said bentonite into and through said die opening.

4. A method as defined in claim 1 wherein said bentonite clay is sheared by repeatedly moving a wiper blade in contact with an extrusion wall surrounding said die opening as said bentonite clay is extruded through said die opening.

5. A method as defined in claim 4 wherein said wiper blade is continuously rotated across said die opening as said bentonite clay is extruded therethrough.

6. A method as defined in claim 5 wherein said wiper blade is rotated so that said bentonite clay is sheared at said die opening 4,000 to 10,000 times per minute.

7. A method as defined in claim 1 wherein said bentonite is ground after passing through said die opening so that 85% of said bentonite passes a 200 mesh screen.

8. A method of drilling comprising:

collecting a mass of bentonite in a housing;

forcing said bentonite toward and through a die opening;

moving a wiper blade against an entrance side of said die opening as said bentonite is forced through said die opening, said wiper blade being in physical contact with a wall portion surrounding said die opening to form a modified bentonite having improved viscosity and fluid loss characteristics;

grinding said bentonite forced through said die opening to a predetermined particle size;

rotating a drilling bit within an earthen structure to form a drill hole defined by a surrounding earthern structure; and circulating a drilling fluid containing said ground modified bentonite within said drill hole to cool and lubricate said drilling bit and carry away drill cuttings from said drill hole.

9. A method as defined in claim 8 wherein said bentonite clay contains 20–45% by weight water when extruded.

10. A method as defined in claim 9 wherein said bentonite clay contains 20–30% by weight water when extruded.

11. A method as defined in claim 8 wherein the die opening is circular having a diameter in the range of 1/16 inch to ¾ inch.

12. A method as defined in claim 8 wherein said bentonite is ground after passing through said die opening so that 85% of said bentonite passes a 200 mesh screen.

13. In a method of drilling comprising rotating a drilling bit in contact against a planetary surface to cut away a portion of said planetary surface thereby forming drill cuttings, and circulating a drilling fluid containing ground bentonite around said drilling bit to remove a portion of said drill cuttings, the improvement comprising pretreating said bentonite prior to circulating said bentonite around said drilling bit by forcing said bentonite toward and through a die opening while moving a wiping blade against an entrance side of said die opening as said bentonite is forced through said die opening, said wiping blade being in physical contact with a wall portion surrounding said die opening, to improve the viscosity and fluid loss characteristics of said drilling fluid, and thereafter grinding said bentonite to a desired particle size.

14. The method of claim 13 wherein said wiping blade includes a plurality of spaced, tapered blades.

15. The method of claim 14 wherein said wiping blade includes a tapered blade, tapered at an angle of 5° to 80°.

16. In a method as defined in claim 13 wherein said bentonite is ground after passing through said die opening so that 85% of said bentonite passes a 200 mesh screen.

* * * * *